US011583112B2

(12) United States Patent
Ribeiro Pinto et al.

(10) Patent No.: US 11,583,112 B2
(45) Date of Patent: Feb. 21, 2023

(54) STRUCTURAL ARRANGEMENT INTRODUCED IN A PHOTO FRAME

(71) Applicants: Daniel Ribeiro Pinto, Paraná (BR); Luigi Mascheroni, Lombardia (IT)

(72) Inventors: Daniel Ribeiro Pinto, Paraná (BR); Luigi Mascheroni, Lombardia (IT)

( * ) Notice: Subject to any disclaimer, the term of this patent is extended or adjusted under 35 U.S.C. 154(b) by 0 days.

(21) Appl. No.: 17/012,127

(22) Filed: Sep. 4, 2020

(65) Prior Publication Data

US 2021/0361091 A1 Nov. 25, 2021

(30) Foreign Application Priority Data

May 19, 2020 (BR) ..... 10 2020 009944 2

(51) Int. Cl.
*A47G 1/06* (2006.01)
*A47G 1/10* (2006.01)

(52) U.S. Cl.
CPC ..... *A47G 1/0622* (2013.01); *A47G 1/102* (2019.08); *A47G 2001/0661* (2013.01)

(58) Field of Classification Search
CPC ..... A47G 1/0622; A47G 1/102; A47G 2001/0661
See application file for complete search history.

(56) References Cited

U.S. PATENT DOCUMENTS

| | | | | |
|---|---|---|---|---|
| 4,058,215 | A | 11/1977 | Marchbank | |
| 9,421,816 | B2 | 8/2016 | Stas | |
| 10,573,206 | B1 * | 2/2020 | Canaphany | G09F 13/0404 |
| 10,909,890 | B1 * | 2/2021 | Apostle | G09F 13/0413 |
| 10,948,176 | B1 * | 3/2021 | Johnston | A47G 1/0622 |
| 2020/0005685 | A1 * | 1/2020 | Anderson | G09F 15/0018 |

FOREIGN PATENT DOCUMENTS

| | | | |
|---|---|---|---|
| BR | 9705737 | A | 6/1999 |
| CN | 1295144 | A | 5/2001 |

* cited by examiner

*Primary Examiner* — Cassandra Davis
(74) *Attorney, Agent, or Firm* — Pilloff Passino & Cosenza LLP; Sean A. Passino; Rachel K. Pilloff

(57) ABSTRACT

This patent of invention relates to structural arrangement introduced in a photo frame, applied in the area of furniture decoration for the purpose of storage of photos or images in a closed and weather-protected environment, which aims to personalize the printing of photos and images and their changing, through the innovative constructiveness structural profiles (1), joining brackets (2), screws (3), fabric (4), lighting bars (5), support (6), cover (7) e sheet (8), with advantages of being easy in the process of taking/choosing the art to be printed, reduction in the time needed to purchase the product, easy to understand, light, of simple assembly, with flexibility and ease of changing photos and images, being non-destructive in the change, using internal lighting and having communication with the user.

3 Claims, 6 Drawing Sheets

STRUCTURAL ARRANGEMENT INTRODUCED IN A PHOTO FRAME

Figure 1:
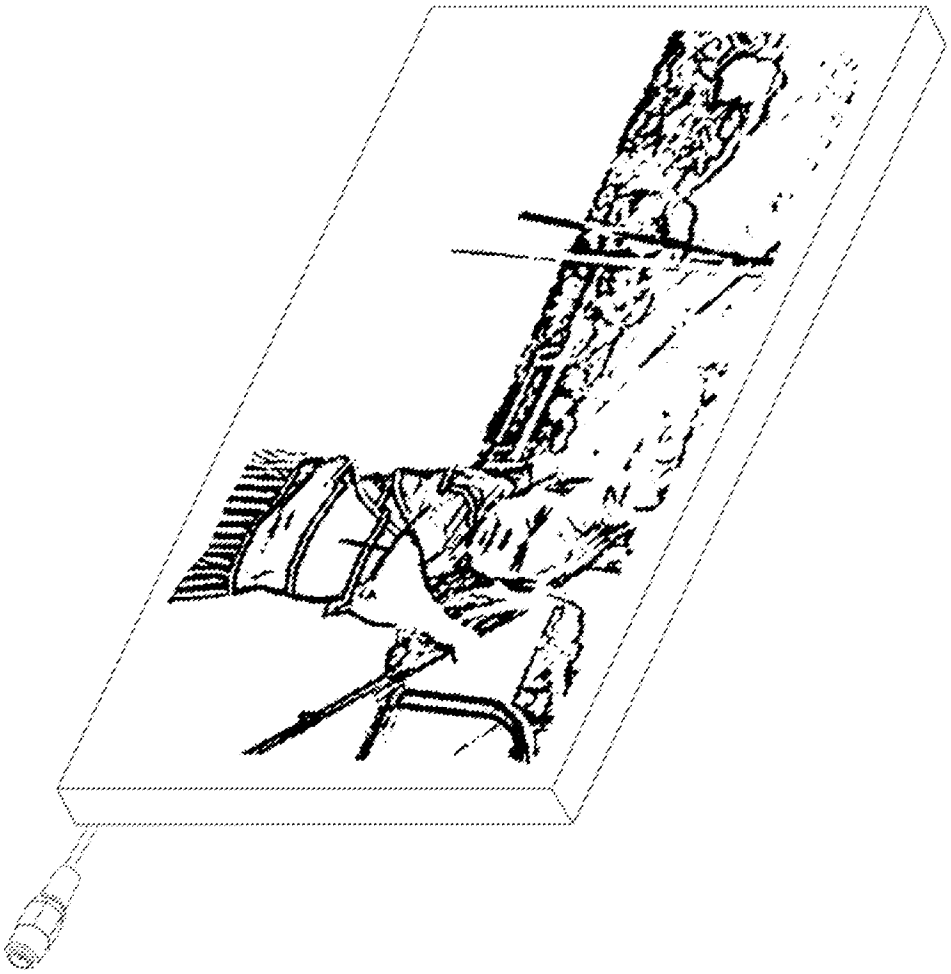

This application claims the benefit of Brazil Application No. 10 2020 009944 2 filed on May 19, 2020, the entire disclosure of which is incorporated herein by reference.

This patent of invention relates to structural arrangement introduced in a photo frame, applied in the area of furniture decoration for the purpose of storage of photos or images in a closed and weather-protected environment, which aims to personalize the printing of photos and images and their changing, through the innovative constructiveness that uses the special fitting of the fabric, with the advantages of facilitating the process of taking/choosing the art to be printed, reducing the time necessary for the use of the product, easiness to use, lightness, being ease to assemble, flexible and easy to exchange photos, being non-destructive in the changing of images, using internal lighting, and allowing for communication with the user.

As it is known to the technical means connected to the manufacture and assembly of picture and photo frames, currently there are picture frames that allow snapping and holding photos and pictures with the aid of a rear open, where a cap fits using "swivels" for fitting picture frames on place; and there are selected screens forming posters or fixed in frames with or without glass and with the back of the cover glued. These solutions offer disadvantages, limitations and inconveniences, since the frames are heavy, slow to assemble, with inflexibility and difficulty in changing old photos and pictures, destructive during changes, without use of internal lighting, without communication with the user.

Searching the national and international databases, the following revelations were found:

Brazilian patent PI 9705737-1 denominated "Notice Board", which revealed a solution for any environment that needs notices or messages on a wall. This notice board consists of soft rubberized foam, polyester fabric and crystal PVC with printing printed by the screen printing system, digital photo and transfix, double-sided adhesive tape and box with pins.

U.S. Pat. No. 9,421,816 of title "Apparatus and methods for displaying fabric-based images", that discloses a stretcher frame apparatus and methods for stretching and mounting a fabric, such as canvas, to a supporting surface, such as a wall. The apparatus has two opposing elongated frame members that are attached to opposite sides of a fabric. When the frame members are first mounted to the wall, the fabric will have slack, but the fabric is made taut when the user inserts removable elongated tension member (s) between the wall and rear side of the fabric. Preferably, two tension members are inserted between the wall and the mounted fabric and then slid in opposite directions toward the mounted frame members. This apparatus and method allows a user to forgo cumbersome four-sided box frames, and instead provides a simple, easy to use apparatus for mounting decorative fabric-based images to a wall.

U.S. Pat. No. 4,058,215 denominated "Framed Embroidery Assembly" where a framed textile fabric assembly for use in embroidery is disclosed. The assembly includes an open peripheral frame having a textile fabric fixedly secured across the frame. The user embroiders any desired pattern onto the fabric and then quickly and easily obtains a picture framed work by fitting a member across the back of the frame. A pleasing three-dimensional effect to the embroidered work is obtained by inserting a resilient pad between the embroidered textile fabric and the member.

Chinese patent CN1295144 called "Fabric frame or photo frame with attractive and firm corners", which discloses a photo frame or fabric frame with attractive and firm corners and that belonged to the technical field of moldings and frames. A photo frame or shell fabric frame comprises a frame body defined by frame strips and shell fabric, placed out of a frame body in a cover mode, the shell fabric comprises parts of shell fabric G, portions of shell fabric H connected to portions of shell fabric G and portions of lining fabric F between pieces of lining fabric G, the portions of lining fabric G cover an upper surface, an outer side face and the lower outer surface of the body of the structure, the parts of the covering fabric H cover the inner side face of the body and the parts of the shell fabric F are arranged in cutting joints between the strips of the structure. The photo frame or canvas frame with attractive and firm corners is of simple structure and reasonable design and includes the frame body and the cover fabric, the cover fabric covers the outer surface of the frame body and the fabric of the cover, and the corners of the side edges of the frame body are hidden in the clearances at the connection positions of the corner of the frame tie joint. In this way, the problem that fabric at the shell in the corner junction edges is fitted in an inflexible and uninteresting way is ingeniously solved.

The disclosed patents have disadvantages, limitations and drawbacks, as they use heavy materials for making the canvas, the frames are made of wood, and the fabric is permanently attached or fixed to the frame. Additionally, Brazilian patent uses foam, and the patent that uses fabric with image has a fixation structure only at the ends, which leaves the fabric exposed to damage in its central part.

"STRUCTURAL ARRANGEMENT INTRODUCED IN A PHOTO FRAME", object of the present patent, was developed to overcome the limitations, inconveniences and disadvantages of the current frames, because through innovative constructiveness that uses a movable frame with special profiles to receive the fabric and uses trims with stitched elastomer edge, forming a flexible frame around the fabric, adopting electronics and active immersive application to take photos, upload the image, confirm the product and shipment, with light and easy to assemble and disassembled components, ease in the process of taking/choosing the art to be printed, reduction in the time needed to purchase the product, easy to understand, light, of simple assembly, flexibility and ease of changing photos and images, without the danger of cutting because glass is not used in the assembly, non-destructive in the change, use of internal lighting and communication with the user.

Technical problems that the previous ones do not solve and how it was solved by the frame of the present patent:

a) The current frames have complicated fixation and need multiple tasks for the acquisition of the final product, solved by the present patent by presenting ease of handling and application and unification of services in one place.

b) In the current picture and photo frames with printed screens, changing the photo or image damages part of the structure and cover by being glued or stapled, solved by the present patent by presenting special inserts for disassembly without the use of glue or clamp for fixing, leaving the structure intact to receive a new image.

c) Current picture or photo frames do not allow built-in lighting, resolved by the present invention through the adoption of UVHD ink and LED lighting.

d) The current frames do not allow communication with the user, solved by the present invention through the adoption of electronics and immersive application.

For better understanding of the present invention, the following drawings are attached:

FIG. 1., which shows the perspective view of the assembled photo frame from the present patent.

Figure 2:
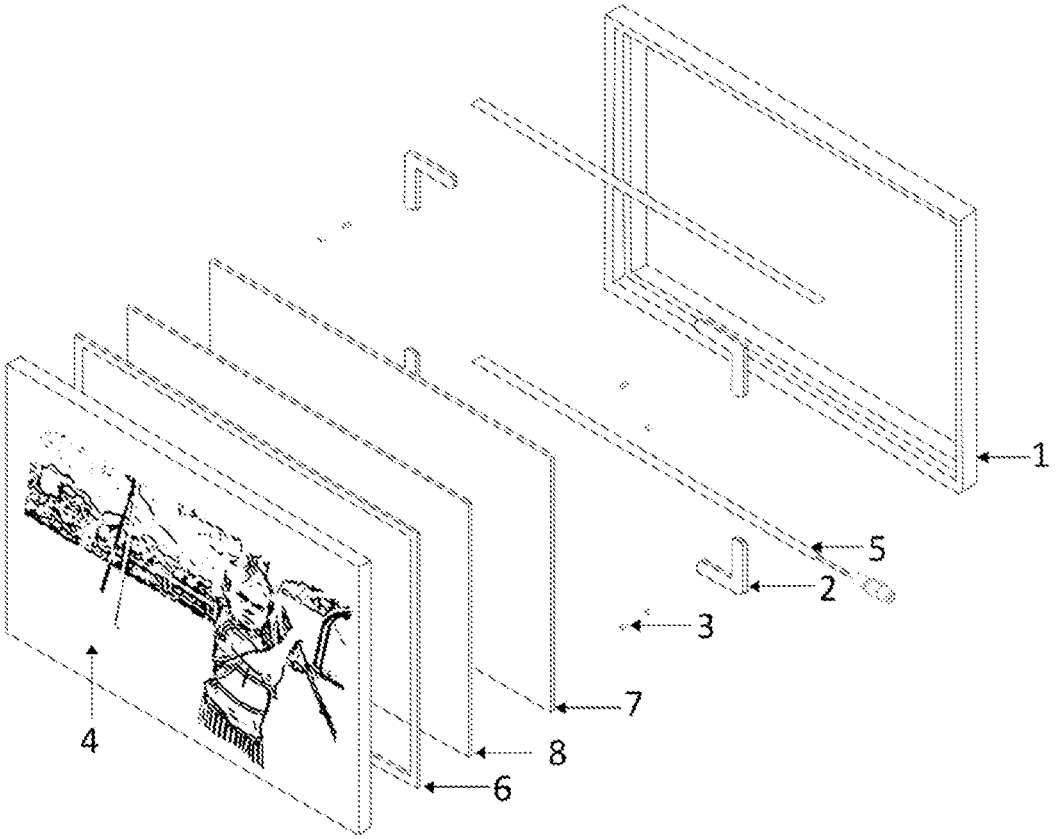

FIG. 2., which shows the exploded perspective view of the mounted photo frame from the present patent.

Figure 3:
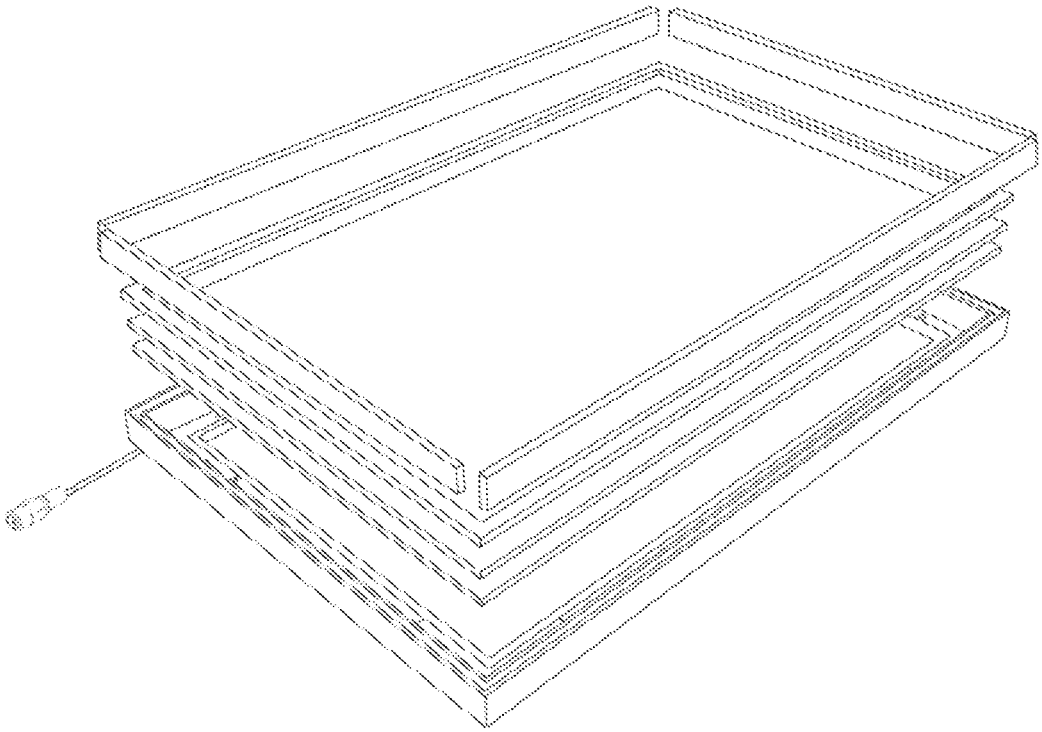

FIG. 3., which shows the exploded perspective view of the photo frame of the present patent, without the fabric.

Figure 4:
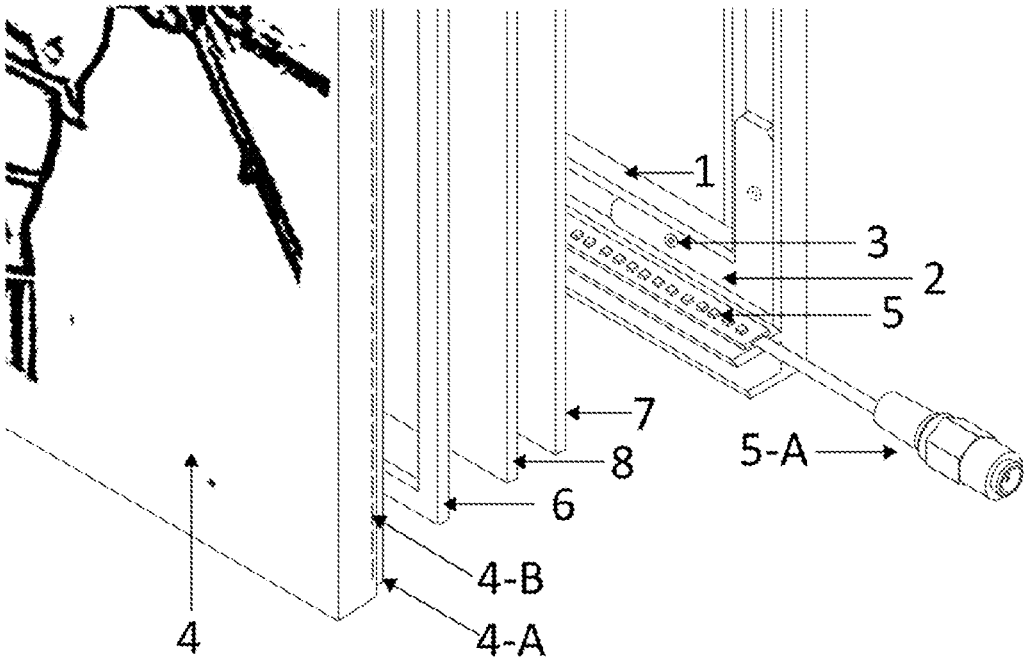

FIG. 4., which shows the detailed exploded perspective view of the assembly of the photo frame from the present patent.

Figure 5:
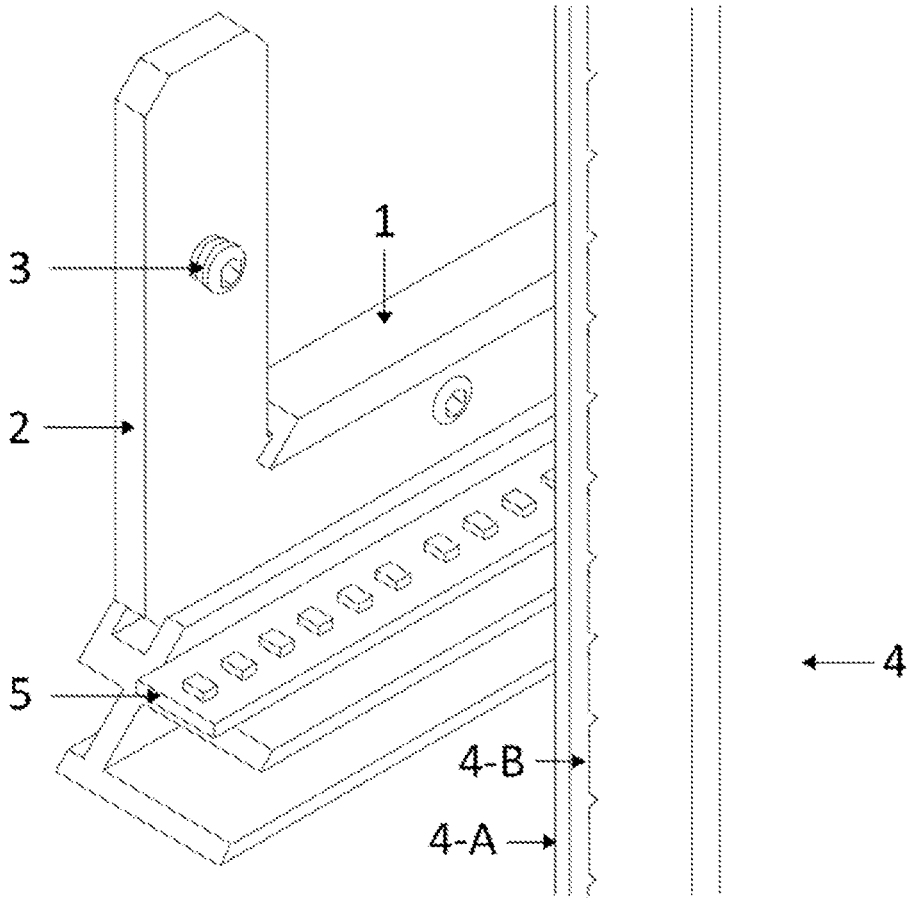

FIG. 5., which shows the perspective view of the assembly of the assembly/union of the mounting bracket with the profile and fixation of the lighting bar of the photo frame from the present patent.

Figure 6:
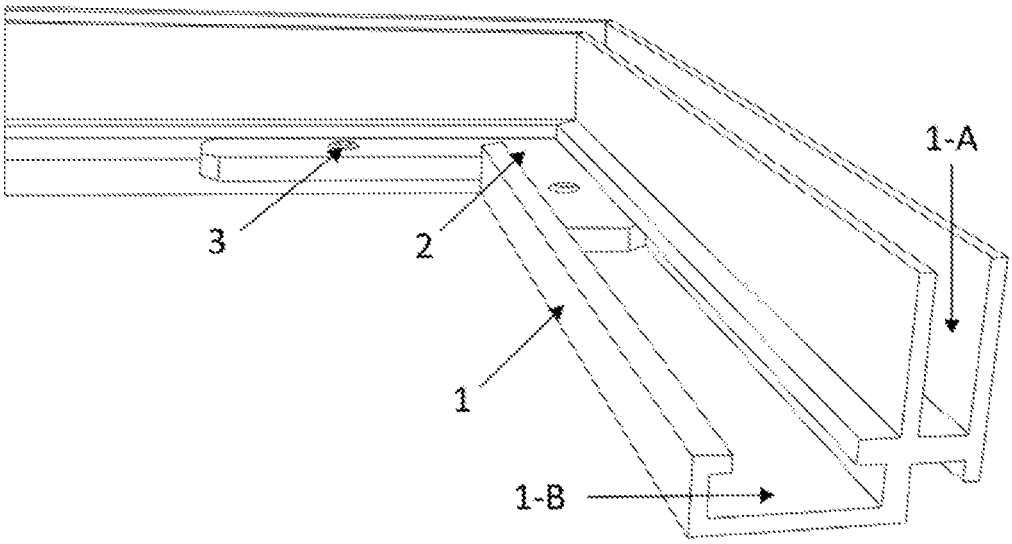

FIG. 6., which shows the detailed perspective view of the shape of the profile of the photo frame of the present patent.

According to the aforementioned figures, the photo frame of the present patent consists of four structural profiles (1) of special shape made of light metal, for example aluminum, with elongated "U" shaped channel (1-A) for fitting the fabric trim (4-A), with groove (1-B) in a "C" shape for fitting the joining brackets (2), four joining brackets (2) made of light metal with two holes each and fixed on the tips of the profiles (1) by screws (3) on the inside of the profiles (1), tensioned fabric with printed art (4) of polygonal format and printed with ink, with a rectangular or square trim (4-A) with seam (4-B) on the edge of the fabric (4), lighting bars (5) of LEDs or similar positioned and fixed on the inner side of the profile (1) electrically actuated by force cable (5-A), support (6) of rectangular section for fixing the plate (8), cover (7) of rectangular shape with material finish with, for example, opaque, translucent or solid colors and sheet (8) of rectangular shape in transparent material and fixed on the support (6).

The photo frame of the present patent is assembled as follows:

A) Fix the joining brackets (2) to the profiles (1), using the grooves (1-B) and secure them by tightening the screws (3);

B) Insert the lighting bars (5) in the internal part of the channel (1-A), fixing them in the internal part of the profiles (1);

C) Fit the cover (7) together with the plate (8) to the support (6) between the profiles (1); and D) Fit the fabric (4) to the profiles (1), attaching the fabric (4) to the trim (4-A) in the channel (1-A), leaving the force cable (5) out of the structure which will be fed by a source of electrical energy.

The operation of the photo frame of the present patent is as follows:

1) the user will download the application;

2) the user will perform the registration and login;

3) the user will select the image, finish the structure and finalize the order;

4) with all the configurations selected, the product will be manufactured and sent to the user, and may have more than one printed fabric, or one or more frames according to the number of images and measures requested by the customer;

The invention claimed is:

1. A structural arrangement introduced in a photo frame, comprising, four joining brackets (2) and four structural profiles (1) made of light metal, each with an elongated "U" shaped channel (1-A) for fitting a fabric trim (4-A), with channel (1-B) in a "C" shape for fitting one of the four joining brackets (2), wherein the four joining brackets (2) are made of light metal with two holes each and fixed on a tip of the respective structural profiles (1) by screws (3) on an inside of the respective structural profile (1), a tensioned fabric with printed art (4) of a polygonal format and printed with ink, with a rectangular or a square trim (4-A) with a seam (4-B) on an edge of the tensioned fabric with printed art (4), LED lighting bars (5) positioned and fixed on an inner side of the structural profile (1) electrically triggered by a force cable (5-A), a support (6) of rectangular section for fixing a plate (8) of rectangular shape and of a transparent material, a cover (7) of rectangular shape with material finish and a sheet (8) of rectangular shape and of the transparent material and fixed on the support (6).

2. The structural arrangement introduced in the photo frame of claim 1, wherein the light metal of the four structural profiles (1) is aluminum.

3. The structural arrangement introduced in the photo frame of claim 1, wherein the material finish is opaque, translucent or solid colors.

* * * * *